United States Patent [19]

Kling

[11] 3,986,458

[45] Oct. 19, 1976

[54] POWER AND FREE CONVEYOR

[75] Inventor: Georg Kling, Bonn, Germany

[73] Assignee: Pohlig-Heckel-Bleichert Vereinigte Maschinenfabriken Aktiengesellschaft, Cologne, Germany

[22] Filed: Mar. 18, 1975

[21] Appl. No.: 559,644

[30] Foreign Application Priority Data

Mar. 21, 1974 Germany ..... 2413653

[52] U.S. Cl. ..... 104/172 S; 188/60

[51] Int. Cl.² ..... B61B 10/02

[58] Field of Search ..... 104/172 R, 172 S, 178, 104/89, 94, 96; 188/60, 61, 82.1

[56] References Cited

UNITED STATES PATENTS

| | | | |
|---|---|---|---|
| 3,314,378 | 4/1967 | Potter et al. | 104/172 S X |
| 3,354,834 | 11/1967 | Orwin | 104/172 S |
| 3,357,369 | 12/1967 | Dehne | 104/172 S |
| 3,426,700 | 2/1969 | Klamp | 104/172 S X |
| 3,672,306 | 6/1972 | Dehne et al. | 104/89 |
| 3,759,189 | 9/1973 | Desilets | 104/172 S |

*Primary Examiner*—Robert J. Spar
*Assistant Examiner*—Randolph A. Reese
*Attorney, Agent, or Firm*—Karl W. Flocks

[57] ABSTRACT

A train comprises a towing car and at least one free car connected to the towing car and having a car body. At least one of the free cars is a load-carrying free car, which comprises two pairs of guide rollers and carries a load suspended from the car body. A track carries the train and comprises a lower track rail, which has an upwardly facing backing surface engageable by the guide rollers. A driving chain extends along the track and is operable to move along the track. Coupling is provided for releasably coupling the towing car to the driving chain for movement therewith along the track in such a direction that the towing car precedes the at least one free car. Carried by one of the load-carrying free cars is a horizontal pivot which is fixed to the car body, a retaining member which is mounted on the pivot for pivotal movement and extends adjacent to the lower track rail and substantially at right angles to the backing surface, and a backing strip carried by the retaining member and having a knife edge, which by a pivotal movement of the retaining member is engageable with the backing surface. The knife edge is arranged to engage the backing surface under the action of a force exerted by one-half of the load in response to a movement of the original one load-carrying free car opposite to the direction of movement.

14 Claims, 7 Drawing Figures

POWER AND FREE CONVEYOR

This invention relates to retaining and stabilizing means for load-carrying elements of a power and free conveyor, particularly for use at stacking sections and stops, or for use in case of a change of the drive, which means are intended for use at an intermediate load-carrying car, which preferably directly follows the towing car, when said load-carrying car is arranged in a lower track rail of a stacking section or the like.

In the operation of known power and free conveyors, the single consignments to be conveyed may be damaged by uncontrolled motions and rebounds of the consignments in stacking sections or at stops. For instance, a slip of the consignment on the carrying means of the load-carrying car may cause damage to the surface finish or multiple rebounds within stacking sections or at stops may cause the consignment to depart from their predetermined path.

Multiple rebounds may occur when the leading towing car runs back, opposite to its direction of travel, and at the main driving dog, which is in position for engagement, is again engaged by the pusher dog carried by the chain, so that the consignments impinge and cause the towing car to return once more.

This action to be avoided may be described as an uncontrolled stabilization of the train or consignments in connection with load-carrying elements which are rigidly mounted in the direction of travel and particularly in connection with load-receiving means which are articulated to be movable in the direction of travel.

Several solutions to this problem have been disclosed.

According to the U.S. Pat. No. 3,397,650, a braking device for power and free conveyors provides for a frictional contact between the car and the track rail. The braking element is secured to an actuating claw. The braking action depends on the surface properties of the track rail, which after prolonged operation may have an oily or greasy surface, which reduces the static friction of the brake, and on the accuracy of the arrangement of the track rail, particularly at rail joints, where the rails may be disposed on different levels because there are tolerances due to rolling on the underside of the track rail or there is a tolerance of the thickness of the flanges of the track formed by the lower track rails. Owing to these inaccuracies of the track rails, the action of the brake cars at such locations may not be ensured. The described arrangement requires also a relatively small machining tolerance substantially throughout the power and free conveyor, particularly of the leading and trailing free cars and the actuating lever, which in dependence on the height of the ramp of the car indirectly determines the travel of the brake block and thus determines the extent of the lift, the braking force and the stopping distance as well as the frictional force applied to the track rail. A practical embodiment of this kind would involve a high expenditure because the required precision is not usual in the manufacture of such heavy machines and because the friction depends on the weight of the load to be carried, particularly in case of an inevitable swinging of load-carrying elements. The braking element as such consists of rubber or another resilient element and has vulcanization-bonded friction plates. The friction may be adversely affected by external influences, such as oil, ageing, hardening, breakage and the like. It is highly essential that the thrust force which is applied by the connected load-carrying element to the articulated coupling of the forward free car causes a rotational movement of the leading free car in a sense to disengage the brake block and a lowering in the direction which is opposite to the braking direction. The articulated coupling is vertically spaced from the engaging surface of the trailing free car. The towing car is shown as an unloaded car in a train and the problem relating to the load is not seen in connection with the breaking appliance.

The U.S. patent specification discussed last as well as other known patent specifications, such as the U.S. Pat. No. 3,548,752 and the Opened German specification No. 2,235,713 rely on the static friction of a blocking guide roller or a blocking pair of guide rollers. In that connection, adverse influences, such as the nature of the track, the presence of lubricants on the tread faces for the free cars and the like are inevitable. Besides, the braking means will not be fully operative unless they are manufactured with high precision and at high cost.

In the arrangement disclosed in the Opened German specification No. 2,235,713 the guide rollers or pairs of guide rollers provided on opposite sides must be provided with means for preventing a return movement of the rollers. These means are different for the two directions of travel and do not ensure a static friction between the pair of guide rollers and two channel track rails because the carrying flange of each rail has relatively large dimensional tolerances and because it is impossible to arrange the two track rails exactly on the desired level over long distances and to provide for a uniform transmission by all four guide rollers. The guide rollers are usually rigidly mounted in the free car and cannot move resiliently to compensate irreguarities of the track.

In view of the relatively large distances of travel which are required and which amount, e.g., to a multiple of one hundred meters, and in view of the dimensional tolerances of the rolled channel sections on the market, it is not possible to ensure the four-point support which is proposed in the U.S. Pat. No. 3,548,752 and the Opened German No. 2,235,713 and which would be required for an effective braking and retaining.

All braking devices discussed hereinbefore rely on the frictional contact with the track rails and involve a wear of the track rails and braking members.

A different solution is known from the Opened German specification No. 2,243,316, in which cam members are disclosed, which are pivotally mounted below the track on opposite sides of the free car and which are provided in their top portion with a friction edge and are applicable to the underside of the rails. This arrangement is also highly expensive and requires small manufacturing tolerances and cannot be provided in practice.

In view of the prior art it is an object of the invention to improve the above-mentioned retaining and stabilizing means for power and free conveyors, particularly for use at stacking sections and in stops or for a change of the drive, mainly in that said means serve for a controlled stabilization of the train and can be much simpler in design and less expensive whereas the positions at which the train is stoped are defined without relying on friction, so that the wear due to friction is avoided, also to prevent the leading towing car or cars, which is or are preferably unloaded, from leaving the horizontal path of travel (rising, bucking), relative to the arresting stop or stops as a result of the pressure which is due to a restraint of the load-carrying cars and possibly to avoid stresses which are due to an accumulation of a plurality of load-carrying cars in stacking sections.

According to the invention this is accomplished in that in a train of cars a load-carrying car comprising two pairs of guide rollers is provided with a retaining member, which is provided with a backing strip and is attached adjacent to the inside profile of the lower track rail and extends substantially at right engles to the lower inner flange surface and is vertically pivotally movable about a pivot which is fixed to the body of the free car, the arrangement being such that a return movement of the load-carrying train or an intermediate load-carrying car after the stacking operation causes the backing strip to bear with its edge against the inside profile of the track rail and one-half of the load which is suspended from the trolley of the car exerts the backing force which is required to stabilize the train whereas the rear ramp of the rear free car is provided with an additional buckle, which serves to clamp the rigid tongue of the leading towing car.

In a preferred embodiment of the invention the assembly of the retaining member and backing strip is designed so that the center of gravitiy of said assembly is spaced from the pivotal axis in a direction which is at right angles to the rail when said assembly is freely suspended.

The backing strip is preferably wedge-shaped on its side facing the track rail and is provided on said side with a portion which is similar to a knife edge which conforms to the inclination of the flange of the track rail.

The backing strip consists preferably of hardened, wear-resisting material.

It will also be desirable to provide a backing strip which extends in the direction of the width of the retaining member and which is replaceable and adjustable in height.

In a modification of the invention the pivot which is fixed to the free car is disposed above the lower track rail and the backing strip carried by the retaining member is provided with a knife edge which extends substantially parallel to the track and is engageable with the top surface of the track rail.

In a preferred embodiment of the invention, the stabilized free car bears on the track rail at three points, namely, with the knife edge of the backing strip and with the two guide rollers of the trailing pair of guide rollers.

Further advantages and features of the invention wil become apparent from the following description of embodiments of the invention shown by way of example on the accompanying drawings, in which FIG. 1 is a side elevation showing a load-carrying train, which comprises an unloaded towing car, an unloaded rear free car provided with a stacking ramp, and two load-carrying intermediate cars, which are connected by beams.

Figure 1:
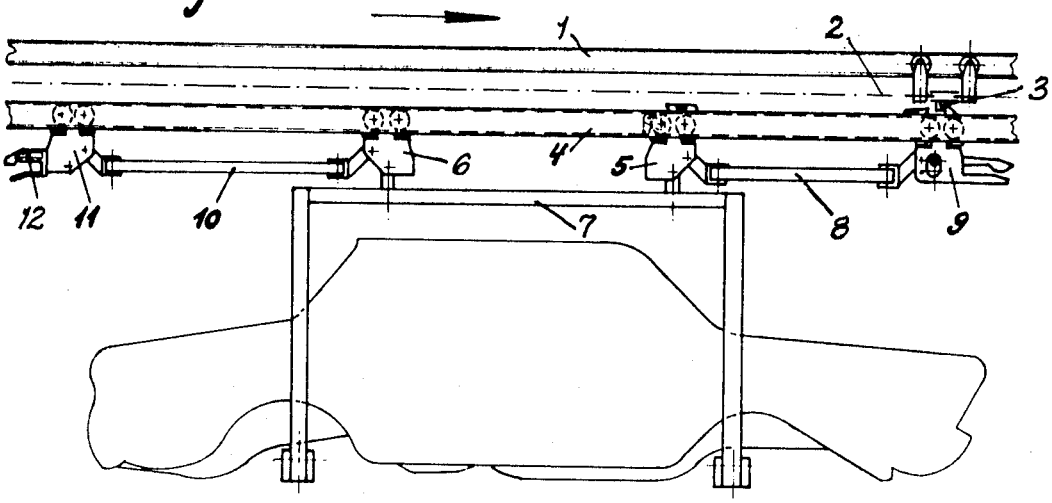

A stacking section of a power and free conveyor comprises an upper track 1 for a towing chain 2, which is provided with pusher dogs 3, and a lower track 4 for load-carrying trains. In the embodiment of the invention shown in FIG. 1, the lower track 4 carries two load-carrying intermediate cars 5, 6 which comprise two pairs of guide rollers each, engaging an upwardly facing backing surface of track 4, and are provided with load carriers 7. The right-hand intermediate load-carrying car 5 is connected by a tie rod 8 to an unloaded, leading towing car 9. On the other end, a load-carrying intermediate car 6 is connected by a tie rod 10 to a rear free car 11, which is preferably unloaded and which is provided with a stacking ramp 12.

Figure 2:
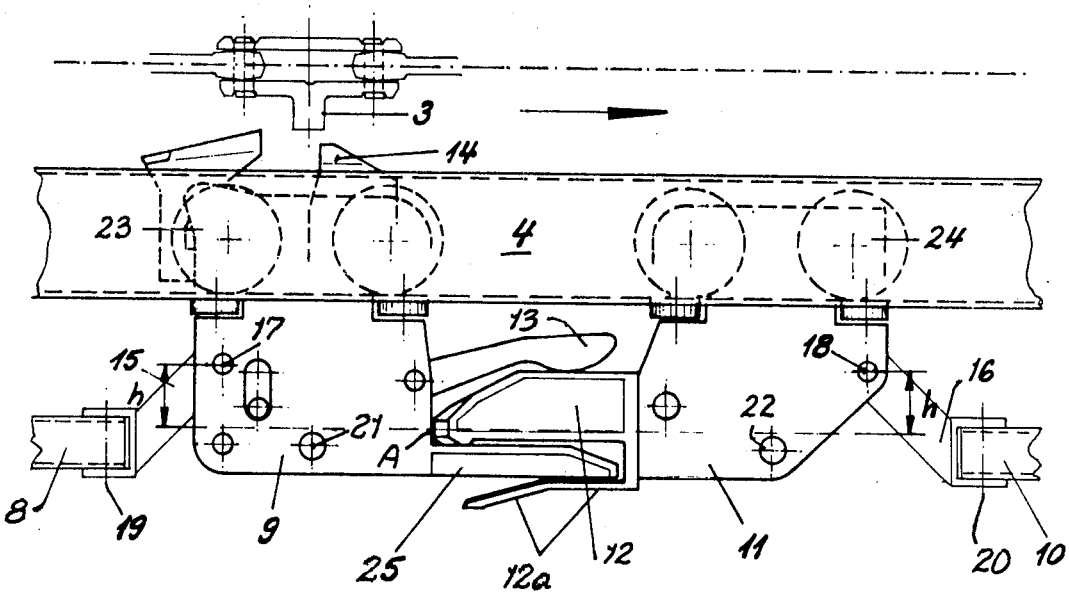
FIG. 2 is a side elevation showing the condition of a leading towing car and a rear free car provided with a stacking ramp during a stacking operation.

In the stacking section 1, 4, the preferably unloaded, leading towing car 9 rides up on a rear free car 11, which is provided with a stacking ramp 12. As a result, an actuating lever 13 of the leading towing car 9 retracts a main driving dog 14 so that the latter is disengaged from a pusher dog 3 carried by the chain (FIG. 2).

The tie rods 8, 10 are connected by pivoted links 15 and 16 and pins 17, 18 to the leading towing car 9 and the rear free car 11, respectively. The pins 17, 18 are provided for the vertical movements. Additional pins 19, 20 are provided for horizontal pivotal movements. The pins 17, 18 are generally arranged on a predetermined lever above load-connecting bores 21, 22 in the lower portion of the free car.

During a stacking operation, the thrust produced by the mass of the load carriers 7 and the load is transmitted by the tie rod 8 to th pin 17 of the leading towing car 9. The pin 17 is offset by a vertical distance *h* from an engaging surface A of the rear stacking ramp 12. This would cause the leading towing car 9 and the rear free car 11 to depart from the horizontal path of travel which is required (bucking, elevating) so that a pair of guide rollers 23, 24 would engage the top inner rail flange and a stress due to a restraint would be produced within the stacked cars and the entire load-carrying train. This highly undesirable action is known to take place where conventional braking means are used, which prevent a return movement of the train. The stress due to the restraint is increased when succeeding trains impinge on the stopped train and particularly with the extent to which the preceding cars are pushed ahead by the impinging trains and because a return movement of the preceeding cars is prevented by the brakes.

Figure 3:
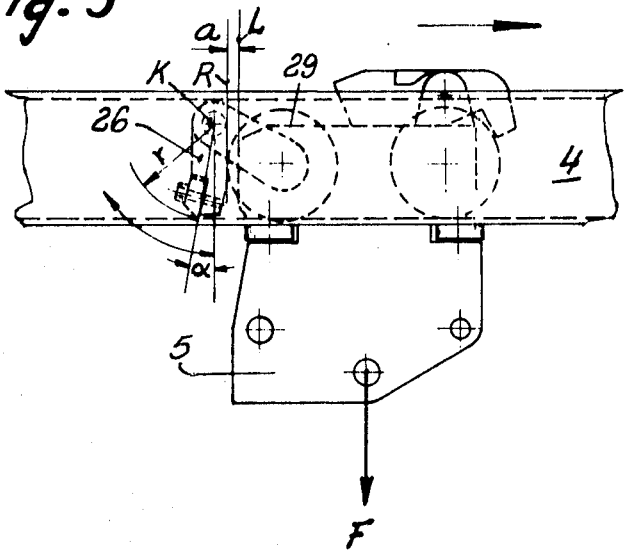
FIG. 3 is a side elevation showing a load-carrying free car provided with a retaining device.
Figure 4:
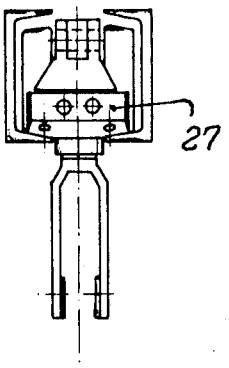
FIG. 4 is a front elevation showing a free car with a retaining device shown in a sectional view taken transversely to the rails.
Figure 5:
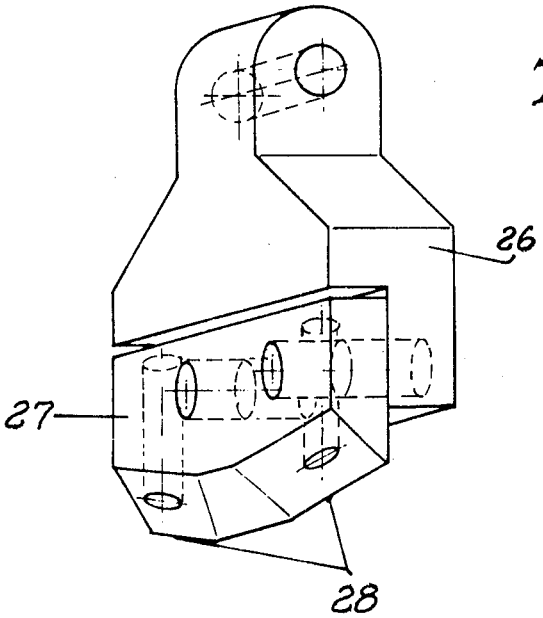
FIG. 5 is a perspective view showing by way of example an embodiment of a retaining member provided with a backing strip.
Figure 6:
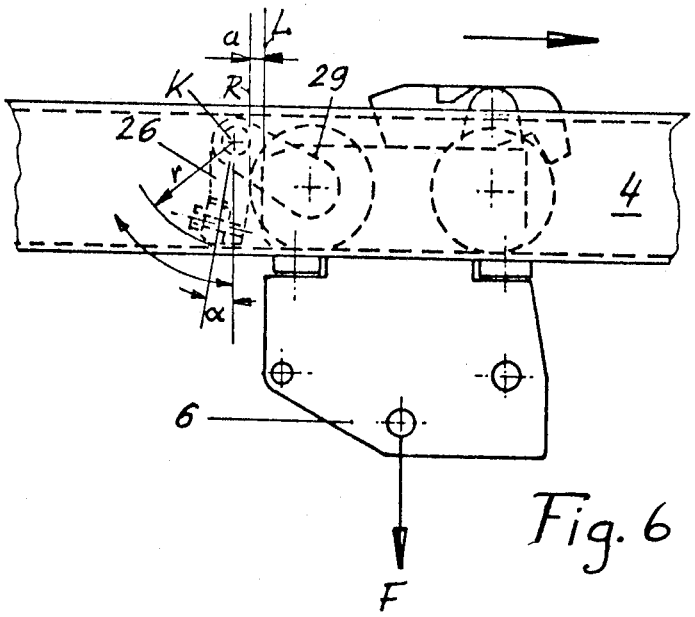
FIG. 6 is a side elevation of another load carrying free car than that of FIG. 3 with a retaining device.

As shown in FIG. 6, the retaining member 26 can be mounted on the rear car 6 instead of the leading car 5 as shown in FIG. 3.

This action is prevented in that the rear ramp 12 mounted on the rear free car 11 is provided with a buckle 12*a*, which firmly embraces and substantially grips the rigidly mounted tongue 25 of the leading towing car 9 during the stacking operation and when the pusher dog 3 carried by the chain is disengaged from the main driving dog by the actuating claw 13. This gripping ensures an engagemennt substantially at two points, namely, in the inner end portion of the buckle and at the outer lower end of the ramp, so that vertical movements of the cars and stresses due to a restraint are virtually precluded.

One of the load-carrying intermediate cars, preferably the car 5 directly following the towing car 9, is provided adjacent to the lower track rail 4 with a retaining member 26, which is vertically pivotally movable about a pivot K and with which a vertically adjustable backing strip 27 is associated, which is provided at its lower edge with wedge-shaped portions 28 similar to a knife edge. The shape of the knife edge-like portion 28 preferably conforms to the inclination of the flange of the track rail 4 (FIG. 3). The assembly comprising the retaining member 26 and the backing strip 27 is so arranged in the track rail 4 and so designed that the center of gravity of said assembly lies substantially vertically under the axis of the pivot K and the knife edge portion 28 of the backing strip extends at right angles to the track rail 4. Viewed in the direction of travel, the edge of the knife edge portion 28 of the backing strip 27 is spaced apart from the adjacent pair of guide rollers 29 by a larger distance than the pivotal axis K. This arrangement ensures a continuous contact of the retaining member with the inside profile of the track rail. Such contact is required for a backing during a return movement of the car 5.

The replaceable backing strip consists preferably of a hardened, wear-resisting material. The angle between the backing strip 27 and the track rail 4 is adjustable to vary the retaining action.

The retaining and stabilizing means have the following mode of operation. The stabilizing action of the retaining means will be eliminated when the car after the stacking operation merely attempts to return rather than actually returning. The return movements performed by the train after the stacking operation particularly in case of swing loads and at relatively high speeds of travel cause the retaining member 26 to be forced against the inside profile of the track rail 4 so that the pair of guide rollers 29 adjacent to the retaining member 26 are lifted clear of the lower portion of the inside profile by some millimeters within the track rail 4. As a result, the free car 5 is pivotally moved in such a manner that the knife edge 28 moves on a radius $r$ about the axis of a pivot K which is fixed to the body of the free car so that the knife edge 28 moves through an angle $\alpha$ and the adjacent pair of guide rollers 29 are moved over a distance $a$ between the engaging surface L of the free car 5 and the rear surface R of the retaining member 26.

As a result, the position of the free car 5 is defined by three points of engagement. As far as the backing action is concerned, the trailing pair of guide rollers 29 are replaced by the backing strip 27 provided with the knife edge 28.

Owing to the engagement at three points, which are exactly geometrically defined, the action of one-half of the load F suspended from the free car 5 is transmitted by the retaining member 26 to the backing strip 27 provided with the knife edge 28 so that the required stabilization is ensured. The above-mentioned inaccuracies on the inside of the track rail 4 will not effect the function of the retaining brake.

Figure 7:
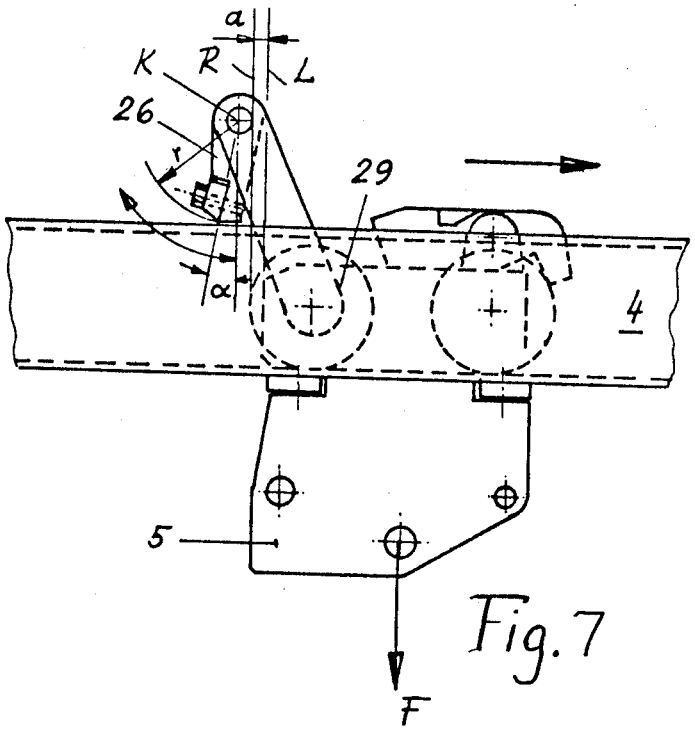
FIG. 7 is a side elevation of another embodiment of the load carrying free car of FIG. 3.

In a modification of the invention as shown in FIG. 7, the pivot K which is fixed to the free car is disposed above the lower track rail 4 and the backing strip 27 of the retaining member 26 has a knife edge extending substantially parallel to the track and bears on the top surface of the track rail 4.

In stacking sections for the entire train, a retaining action is exerted on leading free cars or towing cars, particularly unloaded towing cars, when the main driving dog has been disengaged. This ensures a stabilization of the free cars throughout the track section on which they are restrained. A deformation of the consignments to be conveyed or damage to their surface finish as well as a departure of the consignments from their predetermined direction of travel are avoided.

What is claimed is:

1. A power and free conveyor, which comprises a train comprising a towing car and at least one free car connected to said towing car and having a car body, at least one of said free cars being a load-carrying free car, which comprises two pairs of guide rollers and carries a load suspended from said car body, a track which carries said train and comprises a lower track rail, which has an upwardly facing backing surface engageable by said guide rollers, drive means extending along said track and operable to move along said track, coupling means for releasably coupling said towing car to said drive means for movement therewith along said track in such a direction that the towing car precedes said at least one free car, and retaining and stabilizing means carried by one of said load-carrying free cars and comprising a pivot, which is fixed to said car body, a retaining member which is mounted on said pivot for vertical pivotal movement and extends adjacent to said lower track rail and substantially at right angles to said backing surface, and a backing strip carried by said retaining member said backing strip comprising a wedge shaped portion adjacent to said backing surface and a knife edge, which faces said backing surface and is engageable to mate with said backing surface by a pivotal movement of said retaining member, whereby said knife edge is arranged to be forced against said backing surface by the action of one-half of said load in response to a movement of said one load-carrying free car opposite to said direction.

2. A conveyor as set forth in claim 1, in which said train comprises at least two of said free cars and said retaining and stabilizing means are carried by an intermediate free car.

3. A conveyor as set forth in claim 2, in which said train comprises a rear free car and at least one load-carrying intermediate free car between said towing car and said rear free car and said retaining and stabilizing means are carried by one of said intermediate free cars.

4. A conveyor as set forth in claim 2, in which said retaining and stabilizing means are carried by an intermediate free car immediately succeeding said towing car.

5. A conveyor as set forth in claim 2 in which said free car carrying said retaining and stabilizing means is a rear car of said train.

6. A conveyor as set forth in claim 1, which comprises a stacking station and at least two of said trains, each of which is adapted to stop in said stacking station and has a rear free car which is adapted to permit the towing car of another one of said trains to ride up on said rear car of a train stopped in said stacking station.

7. A conveyor as set forth in claim 6, in which said rear free car has a ramp on which the towing car of another one of said trains is adapted to ride up on said rear car of a train stopped in said stacking station, each of said towing cars is provided with a forwardly protruding, rigid tongue, and said rear ramp is provided with a buckle, which is adapted to clamp and said tongue of a towing car which rides up on said rear car of a train stopped in said stacking station.

8. A conveyor as set forth in claim 1, in which said retaining member and backing strip constitute an assembly having a center of gravity which is spaced from the axis of said pivot in a direction which is at right angles to said backing surface and said assembly when freely suspended assumes a position in which said knife edge is spaced from the axis of said pivot in a direction which is at right angles to said backing surface.

9. A conveyor as set forth in claim 1, in which said backing surface has an inclination and said backing strip, which faces said backing surface is inclined to mate with said backing surface.

10. A conveyor as set forth in claim 1, in which said backing strip consists of a hardened, wear-resisting material.

11. A conveyor as set forth in claim 1, in which said backing strip extends in the direction of the width of said retaining member and is replaceably mounted and adjustable in height.

12. A conveyor as set forth in claim 1, in which said lower track rail has an inside profile including a lower inside flange surface, which constitutes said backing surface.

13. A conveyor as set forth in claim 1, in which said pivot is disposed above said lower track rail and said lower track rail has a top surface, which constitutes said backing surface.

14. A conveyor as set forth in claim 1, in which said two pairs of guide rollers comprise a leading pair of guide rollers remote from said knife edge, and a trailing pair of guide rollers adjacent to said knife edge, and said at least one load-carrying free car is engaging said backing surface at three points, namely with said knife edge and with said guide rollers of said trailing pair, when said knife edge is thus forced against said backing surface.

* * * * *